US007897554B2

(12) United States Patent
Kessler et al.

(10) Patent No.: US 7,897,554 B2
(45) Date of Patent: Mar. 1, 2011

(54) CLEANING COMPOSITIONS FOR GLASS SURFACES

(75) Inventors: Arnd Kessler, Monheim (DE); Haitao Rong, Darmstadt (DE); Wolfgang Wick, Dormagen (DE); Matthias Schweinsberg, Hamburg (DE)

(73) Assignee: Henkel AG & Co. KGaA, Duesseldorf (DE)

( * ) Notice: Subject to any disclaimer, the term of this patent is extended or adjusted under 35 U.S.C. 154(b) by 0 days.

(21) Appl. No.: 12/478,325

(22) Filed: Jun. 4, 2009

(65) Prior Publication Data

US 2009/0298736 A1 Dec. 3, 2009

Related U.S. Application Data

(63) Continuation of application No. PCT/EP2007/058724, filed on Aug. 22, 2007.

(30) Foreign Application Priority Data

Dec. 5, 2006 (DE) ..... 10 2006 057 632

(51) Int. Cl.
*C11D 3/20* (2006.01)
*C11D 17/00* (2006.01)

(52) U.S. Cl. ..... 510/180; 510/222

(58) Field of Classification Search ..... 510/180, 510/222

See application file for complete search history.

(56) References Cited

U.S. PATENT DOCUMENTS

| | | | | |
|---|---|---|---|---|
| 5,073,286 | A * | 12/1991 | Otten et al. | 510/222 |
| 5,080,824 | A | 1/1992 | Bindl et al. | |
| 6,255,434 | B1 | 7/2001 | McGraw et al. | |
| 6,423,661 | B1 | 7/2002 | McGraw et al. | |
| 2003/0153712 | A1 | 8/2003 | Ludewig et al. | |
| 2004/0096507 | A1 | 5/2004 | Kwang et al. | |

FOREIGN PATENT DOCUMENTS

| | | | |
|---|---|---|---|
| EP | 0 352 783 | A2 | 1/1990 |
| EP | 0 383 482 | A2 | 8/1990 |
| EP | 1 245 667 | A1 | 2/2002 |
| EP | 1 553 160 | A1 | 7/2005 |
| WO | WO 00/39259 | A1 | 7/2000 |

OTHER PUBLICATIONS

International Search Report of PCT/EP2007/058724, dated Dec. 18, 2007.

* cited by examiner

*Primary Examiner* — Milton I Cano
*Assistant Examiner* — Thuy-Ai N Nguyen
(74) *Attorney, Agent, or Firm* — RatnerPrestia

(57) ABSTRACT

Multi-armed silyl polyalkoxylates of the formula (I), $(H\text{-}A)_n\text{-}Z\text{-}[A\text{-}B\text{—}Si(OR^1)_r(R^2)_{3-r}]_m$ (I), where Z is an (m+n)-valent radical having at least three carbon atoms, A is a divalent polyoxyalkylene radical, B is a chemical bond or a divalent organic radical having 1 to 50 carbon atoms, $OR^1$ is a hydrolysable group, $R^1$ and $R^2$ independently of one another are a linear or branched alkyl group having 1 to 6 carbon atoms and r is an integer from 1 to 3, and m is an integer ≈1 and n is 0 or an integer ≈1, and m+n has a value from 3 to 100, for reducing glass corrosion and/or for improving the drying performance during mechanical cleaning of a glass surface. Also compositions, in particular for the cleaning of glass surfaces, which compositions contain compounds of the formula (I).

5 Claims, No Drawings

CLEANING COMPOSITIONS FOR GLASS SURFACES

CROSS REFERENCE TO RELATED APPLICATIONS

This application is a continuation under 35 U.S.C. §§120 and 365(c) of International Application PCT/EP2007/058724, filed on Aug. 22, 2007. This application also claims priority under 35 U.S.C. §119 of DE 10 2006 057 632.2, filed on Dec. 5, 2006. The disclosures of PCT/EP2007/058724 and DE 10 2006 057 632.2 are incorporated herein by reference in their entirety.

BACKGROUND OF THE INVENTION

The present invention relates to the technical field of cleaning compositions for glass surfaces and in particular, compositions that reduce the glass corrosion during the automatic cleaning of glass surfaces.

Damage to the surface of glassware during cleaning and/or rinsing procedures is a long known problem which is based firstly on the loss of minerals from the glass composition due to hydrolysis of the silicate network and secondly due to a deposition of silicate material onto the glassware.

Automatic dishwashing can be considered as a specific case of this occurrence, as for example a consumer knows from washing glassware in a typical domestic dishwasher. In particular, the repeated washing of glassware in a dishwasher can cause the above-depicted phenomena to damage the glass surfaces resulting in cloudiness, scratches, smears or the like. These types of adverse effects on the appearance of machine washed glassware illustrate still today one of the most frequent problems encountered with automatic cleaning compositions.

In the prior art, the use inter alia of zinc is proposed to overcome the above problems. For example, the document EP 0 383 482 describes automatic dishwasher cleaning compositions comprising insoluble zinc salts which are characterized by an improved protection against glass corrosion. In order to produce this effect, the insoluble zinc salts must have a particular particle size.

WO 00/39259 discloses water-soluble glasses according to DIN ISO 719 which comprise at least one glass corrosion inhibitor, whose weight fraction in the glass is not more than 85 wt. % and which is released under the conditions of the cleaning and/or rinsing cycles.

However, the compositions known from the prior art are not fully satisfactory. Sometimes they have the disadvantage that they can only be used in the pre-cleaning or main cleaning cycles, or then only act in the rinse cycle when the consumer places a product such as the glasses of the WO 00/39259 in the automatic dishwasher. Sometimes they can indeed be used in the rinse cycle but their performance is unsatisfactory.

U.S. Pat. No. 6,423,661 B1 describes silyl-terminated prepolymers that are manufactured by reacting an isocyanate-silane with the OH groups of a polyether polyol that can possess up to eight arms. The resulting prepolymers of the cited compounds find use in adhesives. A use of the prepolymers, for example in cleaning compositions or for the corrosion protection of glass, has not been disclosed.

A polyurethane prepolymer having terminal alkoxy silane groups and hydroxyl groups is known from US 2003/0153712 A1. For their manufacture, a polyether diol is initially treated with a stoichiometric deficiency of diisocyanate, and the silyl groups are then introduced by further treating the resulting isocyanate-hydroxy compound with an amino silane. The described two armed polyalkoxylates in the form of prepolymers are used in the manufacture of sealants and adhesives.

US 2004/0096507 A1 deals with six-armed polyethylene glycol derivatives and discloses a fully silyl terminated derivative that can be manufactured from: sorbitol as the central moiety. The polyethylene glycol derivatives described in the document are intended to be suitable for manufacturing biologically degradable polymeric hydrogels and for use in the medical/pharmaceutical field for implants.

DESCRIPTION OF THE INVENTION

The object of the present invention consists in providing compositions for decreasing glass corrosion during the automatic cleaning of glass surfaces, said compositions being advantageous in comparison with conventional compositions, in particular having a better activity and/or advantages in regard to the formulation freedom of the active substances comprised in the composition.

It has now been found that certain multi-arm silyl polyalkoxylates are particularly suitable for making available compositions that possess the desired properties.

It has also been found that the use of these silyl polyalkoxylates in the automatic cleaning of glass surfaces improves the drying behavior of the cleaned surfaces. This is understood in particular to mean a shorter drying time and/or a reduced formation of lime scale spots and deposits on the cleaned surfaces.

Accordingly, the subject matter of the present invention is the use of a multi-arm silyl polyalkoxylate of Formula (I) for reducing glass corrosion and/or for improving the drying behavior during the automatic cleaning of a glass surface, wherein in Formula (I)

$$(H\text{-}A)_n\text{-}Z\text{-}[A\text{-}B\text{—}Si(OR^1)_r(R^2)_{3-r}]_m \quad (I),$$

Z stands for a (m+n)-valent group containing at least three carbon atoms, A means a divalent polyoxyalkylene group, wherein the m+n polyoxyalkylene groups that are bonded to Z can be different from one another, and wherein one A group is respectively bonded to Z through an oxygen atom that belongs to Z, and to B or hydrogen through an oxygen atom that belongs to A, B stands for a chemical bond or a divalent organic group containing 1 to 50 carbon atoms, $OR^1$ means a hydrolysable group, $R^1$ and $R^2$, independently of one another mean a linear or branched alkyl group containing 1 to 6 carbon atoms and r stands for a whole number from 1 to 3, and m is a whole number $\geqq 1$ and n stands for 0 or a whole number $\geqq 1$, and m+n has a value of 3 to 100.

The use of the silyl polyalkoxylates of the Formula (I) in the automatic cleaning of glass surfaces improves the drying behavior of the cleaned surfaces. It is particularly advantageous here if the silyl polyalkoxylates are used in a rinse cycle that follows the cleaning cycle.

An improved drying behavior has for example the advantage in domestic automatic dishwashers that once the program has ended, the consumer can remove the cleaned dishes earlier from the machine and use them again. In particular, however, this improvement allows the consumer to use washing cycles at lower temperatures (e.g. 40° C.), at which the drying result was previously unsatisfactory.

In the context of the present invention, multi-armed silyl polyalkoxylates comprise polymer arms that are essentially star-shaped or radially linked to a central moiety.

In a preferred embodiment of the invention, a silyl polyalkoxylate of Formula (I) or a mixture of a plurality of these compounds is employed, wherein the mass average (weight average of the molecular weight) is 500 to 50 000, preferably 1000 to 20 000, and particularly preferably 2000 to 10 000. In this case the silyl polyalkoxylate preferably comprises 0.3 to 10 wt. %, particularly preferably 0.5 to 5 wt. % silicon, based on the total weight of the silyl polyalkoxylate.

Z preferably stands for an at least trivalent, especially tri- to octavalent, acyclic or cyclic hydrocarbon group containing 3 to 12 carbon atoms, wherein the group can be saturated or unsaturated and in particular also aromatic. Particularly preferably, Z stands for the trivalent residue of glycerol or the tri- to octavalent residue of a sugar, for example the hexavalent residue of sorbitol or the octavalent residue of sucrose. The x-valent residue of one of the abovementioned polyols is understood to mean that molecule fragment that remains after the hydrogen atoms have been removed from the x alcoholic or phenolic hydroxyl groups. Fundamentally, Z can stand for any central moiety that is known from the literature for manufacturing star-shaped (pre)polymers.

In addition, it is particularly preferred if in Formula (I) n stands for 0, 1 or 2 and m means a number from 3 to 8.

A preferably stands for groups selected from poly $C_2$-$C_4$ alkylene oxides, particularly preferably for a (co)polymer of ethylene oxide and/or propylene oxide, particularly for a copolymer having a propylene oxide content of up to 60 wt. %, preferably up to 30 wt. % and particularly preferably up to 20 wt. %, wherein the copolymer can be a random or block copolymer. Accordingly, a further preferred embodiment of the invention consists in the use of multi-arm silyl polyalkoxylates of Formula (I), in which A stands for $—(CHR^3—CHR^4—O)_p—$, wherein $R^3$ and $R^4$ independently of one another mean hydrogen, methyl or ethyl and p means a whole number from 2 to 10 000.

B stands in particular for a chemical bond or for a divalent, low molecular weight organic group having preferably 1 to 50, especially 2 to 20 carbon atoms. Exemplary divalent, low molecular weight organic groups are short chain aliphatic and heteroaliphatic groups such as for example $—(CH_2)_2—$, $—(CH_2)_3—$, $—C(O)—NH—(CH_2)_3—$ and $—C(O)—NH—X—NH—C(O)—NH—(CH_2)_3—$, wherein X stands for a divalent aromatic group such as the phenylene group or for an alkylidene group. B stands quite particularly preferably for a bond or for the group $—C(O)—NH—(CH_2)_3—$.

$R^1$ and $R^2$ independently of one another preferably stand for methyl or ethyl, and r for 2 or 3. Examples of groups $—Si(OR_1)_r(R^2)_{3-r}$ are dimethylethoxysilyl, dimethylmethoxysilyl, diisopropylethoxysilyl, methyldimethoxysilyl, methyldiethoxysilyl, trimethoxysilyl, triethoxysilyl or tri-t-butoxysilyl groups, but quite particularly preferably trimethoxysilyl and triethoxysilyl groups.

Quite particularly preferably, $R^1$ and $R^2$ are identical and stand for methyl or ethyl.

Moreover, it is particularly preferred when r stands for the number 3.

The sum of m+n is preferably 3 to 50, especially 3 to 10 and particularly preferably 3 to 8, and is consistent with the number of arms that are bonded to the central moiety Z in the compound (I). Therefore, the central moiety possesses preferably 3 to 50, especially 3 to 10 and particularly preferably 3 to 8 oxygen atoms that are the link points for the arms.

In a particular embodiment, n=0. For the case n>0, the ratio n/m is between 99/1 and 1/99, preferably 49/1 and 1/49, and especially 9/1 and 1/9.

In another preferred embodiment of the invention, a mixture of at least two, especially two to four different multi-arm silyl polyalkoxylates of Formula (I) is employed.

In this case it is particularly preferred when the at least two different multi-arm silyl polyalkoxylates differ in the number of their arms. Here, a first silyl polyalkoxylate with 3 to 6 arms is advantageously combined with a second silyl polyalkoxylate with 6 to 10 arms.

Particularly preferably, a mixture is used that comprises at least two different multi-arm silyl polyalkoxylates of Formula (I) with n=0 which are selected from the group of the multi-arm silyl polyalkoxylates of Formula (I) with m=3, m=6 and m=8.

If two different multi-arm silyl polyalkoxylates are employed, then in general they are present in the ratio 99:1 to 1:99, preferably 49:1 to 1:49, and especially 9:1 to 1:9.

In another particularly preferred embodiment of the invention, the multi-arm silyl polyalkoxylates of Formula (I) are used together with at least one hydrolysable derivative of silica.

Hydrolysable derivatives of silica are understood in particular to mean esters of orthosilicic acid, especially the tetraalkoxysilanes and quite particularly preferably tetraethoxysilane.

In this embodiment, it is particularly advantageous if the ratio of silyl polyalkoxylate or silyl polyalkoxylate mixture to the at least one hydrolysable derivative of silica is 90:10 to 10:90, preferably 50:50 to 10:90 and especially 40:60 to 20:80.

Should the inventively used multi-arm silyl polyalkoxylates of the general Formula (I) not be known from the literature, then they can be manufactured by functionalizing suitable multi-arm polyalkoxylate intermediates in analogy to the functionalization processes known from the prior art.

The two-arm polyurethane prepolymer with terminal alkoxysilane groups and hydroxyl groups which is described in US 2003/0153712 A1 is manufactured by initially treating a polyether diol with a stoichiometric deficiency of diisocyanate, and the silyl groups are then introduced by further treating the resulting isocyanate-hydroxy compound with an amino silane. The synthetic principles applied in this US document can be basically transposed to manufacture multi-arm polyalkoxylates according to the teaching of the present invention.

U.S. Pat. No. 6,423,661 B1 describes silyl-terminated prepolymers that are manufactured by reacting an isocyanate-silane with the OH groups of a polyether polyol that can possess up to eight arms. The teaching of this document includes prepolymers that fall under the general Formula (I) of the present invention.

US 2004/0096507 A1 deals with six-arm polyethylene glycol derivatives and discloses a fully silyl terminated derivative that can be manufactured from sorbitol as the central moiety and falls under the general Formula (I) of the present invention.

Suitable polyalkoxylate intermediates for manufacturing the inventively used silyl polyalkoxylates are themselves also multi-arm polyalkoxylates that already possess the above-described multi-arm structure and which have a hydroxyl group on each end of the polymer arms which can be partially or totally converted into the group(s) $—B—Si(OR^1)_r(R^2)_{3-r}$. The polyalkoxylate precursors of the inventively added silyl polyalkoxylates can be represented by the general Formula (II)

$$Z\text{-}(A\text{-}OH)_{m+n} \quad \text{(II)}$$

wherein Z, A, m and n have the same meaning as previously described for the compounds of the Formula (I).

Exemplary suitable polyalkoxylate precursors are known from the literature with the designation star-shaped or multi-arm polyether polyols. These polyalkoxylate precursors are manufactured by polymerizing suitable monomers, in particular ethylene oxide and/or propylene oxide, with multifunctional small molecules such as for example glycerine or sorbitol as the initiator. As examples of multi-arm polyether polyols, one may cite ethoxylates or propoxylates of glycerine, sucrose and sorbitol, as are described in the U.S. Pat. No. 6,423,661. Due to the statistical nature of the polymerization reaction, the above-cited designations concerning the polymer arms of the inventively used silyl polyalkoxylates, particularly in regard to the arm lengths and number of arms (m+n), are each a statistical average.

Some of the suitable polyalkoxylate precursors are also commercially available. An example is Voranol 4053, a polyether polyol (poly(ethylene oxide-co-propylene oxide)) from DOW Chemicals. It is a mixture of two different polyether polyols, consisting of a 3-arm polyether polyol with glycerine as the central moiety together with an 8-arm polyether polyol having raw sugar as the central moiety. The arms represent statistical copolymers of ca. 75% EO and ca. 25% PO, the OH functionality (hydroxyl end groups) is on average 6.9 for a mass average (weight average of the molecular weight) of ca. 12 000. The outcome of this is a ratio of about 78% of 8-arm polyether polyol and about 22% of 3-arm polyether polyol. Another example is Wanol R420 from the WANHUA company, China, which is a mixture of a linear poly(propylene/ethylene)-diethylene glycol and an 8-arm polyether polyol (poly(propyleneoxy/ethyleneoxy)sucrose) in a ratio of ca. 15-25:85-75. Likewise, the polyether polyol Voranol CP 1421 from DOW Chemicals is commercially available and is a 3-arm statistical poly(ethylene oxide-co-propylene oxide) with an EO/PO ratio of ca. 75/25 and a mass average (weight average of the molecular weight) of ca. 5000.

As starting materials for the conversion of the hydroxyl end groups of the multi-arm polyalkoxylate intermediate into —B—$Si(OR^1)_r(R^2)_{3-r}$ groups, one may consider all functional silanes that possess a functional group that is reactive towards the hydroxyl end groups of the polyalkoxylate intermediate. Examples are tetraalkoxysilanes such as tetramethyl silicate and tetraethyl silicate, (meth)acrylate-silanes such as (3-methacryloxypropyl)trimethoxysilane, (methacryloxymethyl)triethoxysilane, (methacryloxymethyl)methyldimethoxysilane and (3-acryloxypropyl)trimethoxysilane, isocyanato-silanes such as (3-isocyanatopropyl)trimethoxysilane, (3-isocyanatopropyl)triethoxysilane, (isocyanatomethyl)methyldimethoxysilane and (isocyanatomethyl)trimethoxysilane, aldehyde-silanes such as triethoxysilylundecanal and triethoxysilylbutyraldehyde, epoxy-silanes such as (3-glycidoxypropyl)trimethoxysilane, anhydride-silanes such as 3-(triethoxysilyl)propylsuccinic anhydride, halogen-silanes such as chloromethyltrimethoxysilane and 3-chloropropylmethyldimethoxysilane, hydroxy-silanes such as hydroxymethyltriethoxysilane, as well as tetraethyl silicate (TEOS), which are commercially available from e.g. Wacker Chemie GmbH (Burghausen), Gelest, Inc. (Morrisville, USA) or ABCR GmbH & Co. KG (Karlsruhe) or can be manufactured by known processes. Tetraalkoxy-silanes, isocyanato-silanes or anhydride-silanes, but especially tetraalkoxy-silanes, treated with multi-arm polyalkoxylate intermediates of the general Formula (II), are particularly preferred. The exhaustive conversion of all hydroxy ends with the functional silanes yields inventively used multi-arm silyl polyalkoxylates that exclusively bear —B—$Si(OR^1)_r(R^2)_{3-r}$ groups on the ends of the arms, i.e. wherein n=0. In such a case the B group consists exclusively of a bond, or it includes, when an isocyanato silane was used as the functional silane, together with the terminal oxygen atom of the A group for example, a urethane group together with the atom group that stands between the isocyanato group and the silyl group in the starting isocyanato silane. The exhaustive conversion of all hydroxy ends with anhydride-silanes, for example 3-(triethoxysilyl)propylsuccinic anhydride, yields multi-arm silyl polyalkoxylates that exclusively bear —B—$Si(OR^1)_r(R^2)_{3-r}$ groups. In such a case the B group includes together with the terminal oxygen atom of the A group, an ester group together with the atom group that stands between the anhydride group and the silyl group in the starting anhydride-silane.

If inventively used multi-arm silyl polyalkoxylates of the general Formula (I) are manufactured which bear hydroxyl groups as well as —B—$Si(OR^1)_r(R^2)_{3-r}$ groups on the ends of their arms, then the procedure would preferably be as follows: a polyalkoxylate intermediate of the general Formula (II) is reacted with a sub-stoichiometric quantity (based on the total number of hydroxy end groups) of a functional silane, i.e. as described above by initially introducing —B—$Si(OR_1)_r(R^2)_{3-r}$ groups, but without reacting all the hydroxy end groups in the multi-arm polyalkoxylate intermediate. This procedure affords multi-arm polyalkoxylates that bear both hydroxyl groups as well as —$Si(OR^1)_r(R^2)_{3-r}$ groups. Thus, for example, a partial conversion of the hydroxyl ends of a multi-arm polyether polyol with isocyanato silanes affords multi-arm polyalkoxylates that bear terminal silyl groups as well as OH groups ($R^1$=OH). In an additional step, the remaining or a part of the remaining hydroxyl groups can be modified—as described—to —B—$Si(OR_1)_r(R^2)_{3-r}$ groups.

Another subject matter of the present invention is a process for the automatic cleaning of a glass surface in which the glass surface is brought into contact with a multi-arm silyl polyalkoxylate of Formula (I).

Advantageously, this occurs in such a way that the silyl polyalkoxylate in the form of a solution in water and/or in a non-aqueous solvent is metered in during the cleaning process and is brought into contact with the glass surface.

In a particular embodiment, the solution of the silyl polyalkoxylate has an acidic pH, in particular a pH from 1 to 6, preferably from 2 to 4. The solution preferably comprises an acidifier to set the acidic pH.

A particularly preferred embodiment of the inventive cleaning process includes a cleaning step and after this a subsequent rinsing step, wherein the silyl polyalkoxylate is metered in during the rinsing step and is brought into contact with the glass surface.

However it is also possible to meter in the silyl polyalkoxylate in the course of the cleaning step of an inventive cleaning process. In this case for example the silyl polyalkoxylate can also be metered in at the same time or after the cleaning composition typically used in such a process or it can also be metered in as a part of a cleaning composition. In the latter case the silyl polyalkoxylate forms a component of the cleaning composition. Then the silyl polyalkoxylate can be incorporated in a typical way into a cleaning composition. The cleaning composition is preferably a water-soluble portioned package, especially in the form of a tablet or a deep-drawn or injection molded portioned package of a water-soluble film. The silyl polyalkoxylate is advantageously integrated in a cleaning composition in basically the same way as is typically the case for the cleaning composition active substances used for rinsing.

In an inventive cleaning process, compositions are advantageously used that in addition to the silyl polyalkoxylates further comprise at least one non-ionic surfactant.

Accordingly, a subject matter of the present invention is likewise a composition, in particular a cleaning composition, preferably for cleaning a glass surface, and comprising a) 0.05 to 10, preferably 0.1 to 7, particularly preferably 0.2 to 5 and especially 0.3 to 3 wt. % of at least one multi-arm silyl polyalkoxylate of Formula (I)

$$(H\text{-}A)_n\text{-}Z\text{-}[A\text{-}B\text{—}Si(OR^1)_r(R^2)_{3-r}]m \quad (I)$$

wherein

Z stands for an (m+n) valent group having at least three carbon atoms,

A means a divalent polyoxyalkylene group, wherein the (m+n) polyoxyalkylene groups that are bonded to Z can be different from one another, and wherein one A group is bonded to Z through an oxygen atom that belongs to Z and one oxygen atom that belongs to A is bonded to B or hydrogen, B stands for a chemical bond or for a divalent organic group having 1 to 50 carbon atoms, $OR^1$ means a hydrolysable group, $R^1$ and $R^2$ independently of one another mean a linear or branched alkyl group containing 1 to 6 carbon atoms and r stands for a whole number from 1 to 3, and m is a whole number ≧1 and n stands for 0 or a whole number ≧1, und m+n has a value from 3 to 100, b) 0.1 to 40 wt. % non-ionic surfactant(s), and c) optionally water and/or one or a plurality of substances selected from corrosion-protection agents, acidifiers, non-aqueous solvents and solubilizers.

Additional preferred embodiments of the inventive composition comprise at least one multi-arm silyl polyalkoxylate in those preferred developments that were already described in the previous text as the preferred embodiments of the silyl polyalkoxylates of Formula (I).

Moreover, the composition can optionally comprise additional components that are described more closely in the text below. Of course, the optional components are to be selected according to their type and addition quantities such that no unwanted reactions with the silyl polyalkoxylates occur which could impair the stability of the composition.

In a preferred embodiment, the composition further comprises water and/or a non-aqueous solvent as well as an additional optional acidifier besides the at least one multi-arm silyl polyalkoxylate of Formula (I) and a non-ionic surfactant. Moreover, it can be particularly preferred in this case that the composition does not comprise any other ingredients.

It has been found that it is particularly advantageous if the glass corrosion inhibiting silyl polyalkoxylates are present in the last cleaning cycle, i.e. in the rinse cycle. In this manner, the advantageous effect is not diminished by subsequent rinsing steps.

The automatic dishwashing of tableware in household dishwashers normally includes a pre wash cycle, a main wash cycle and a rinse cycle, which are interrupted by intermediate wash cycles. The temperature of the main wash cycle varies between 30 and 75° C. depending on the machine type and program choice. In the rinse cycle, rinsing agents that are usually present in the liquid form are added from a dosing tank into the machine.

Accordingly, another embodiment of the invention is an composition as previously described that represents a composition for the automatic dishwashing of a glass surface, in particular a rinsing agent for the automatic dishwashing and in particular comprises components that are known from the prior art as typical ingredients of a rinsing agent as the additional optional ingredients.

The inventive compositions comprise at least one non-ionic surfactant. Preferred non-ionic surfactants are polyalkylene oxides, in particular alkoxylated, advantageously ethoxylated, particularly primary alcohols containing 8 to 18 carbon atoms and, on average, 1 to 12 moles of ethylene oxide (EO) per mole of alcohol, in which the alcohol group may be linear or, preferably, methyl-branched in the 2-position or may contain e.g. linear and methyl-branched groups in the form of the mixtures typically present in oxo alcohol groups. Particularly preferred are, however, alcohol ethoxylates with linear groups from alcohols of natural origin with 12 to 18 carbon atoms, e.g. from coco-, palm-, tallow- or oleyl alcohol, and an average of 2 to 8 EO per mole alcohol. Exemplary preferred ethoxylated alcohols include $C_{12-14}$ alcohols with 3 EO or 4EO, $C_{9-11}$ alcohols with 7 EO, $C_{13-15}$ alcohols with 3 EO, 5 EO, 7EO or 8 EO, $C_{12-18}$ alcohols with 3 EO, 5 EO or 7 EO and mixtures thereof, such as mixtures of $C_{12-14}$ alcohol with 3 EO and $C_{12-18}$ alcohol with 5 EO. The cited degrees of ethoxylation constitute statistically average values that can be a whole or a fractional number for a specific product. Preferred alcohol ethoxylates have a narrowed homolog distribution (narrow range ethoxylates, NRE). In addition to these non-ionic surfactants, fatty alcohols with more than 12 EO can also be used. Examples of these are tallow fatty alcohol with 14 EO, 25 EO, 30 EO or 40 EO.

Another class of preferred non-ionic surfactants which may be used, either as the sole non-ionic surfactant or in combination with other non-ionic surfactants are alkoxylated, preferably ethoxylated or ethoxylated and propoxylated fatty acid alkyl esters preferably containing 1 to 4 carbon atoms in the alkyl chain, in particular fatty acid methyl esters.

A further class of non-ionic surfactants, which can be advantageously used, are the alkyl polyglycosides (APG). Suitable alkyl polyglycosides satisfy the general Formula $RO(G)_z$ where R is a linear or branched, particularly 2-methyl-branched, saturated or unsaturated aliphatic group containing 8 to 22 and preferably 12 to 18 carbon atoms and G stands for a glycose unit containing 5 or 6 carbon atoms, preferably glucose. There, the degree of glycosidation z is between 1.0 and 4.0, preferably between 1.0 and 2.0 and particularly between 1.1 and 2.0. Linear alkyl polyglucosides are preferably employed, i.e. alkyl polyglycosides that consist of a glucose group and an n-alkyl chain.

Another class of preferred non-ionic surfactants which may be used, either as the sole non-ionic surfactant or in combination with other non-ionic surfactants, are alkoxylated, preferably ethoxylated or ethoxylated and propoxylated fatty acid alkyl esters preferably containing 1 to 4 carbon atoms in the alkyl chain.

Non-ionic surfactants of the amine oxide type, for example N-coco alkyl-N,N-dimethylamine oxide and N-tallow alkyl-N,N-dihydroxyethylamine oxide, and from the fatty acid alkanolamides may also be suitable. The quantity in which these non-ionic surfactants are used is preferably no more than the quantity in which the ethoxylated fatty alcohols are used and, particularly no more than half that quantity.

Other suitable surfactants are polyhydroxyfatty acid amides corresponding to the following Formula,

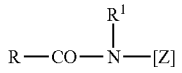

in which RCO stands for an aliphatic acyl group with 6 to 22 carbon atoms, $R^1$ for hydrogen, an alkyl or hydroxyalkyl group with 1 to 4 carbon atoms and [Z] for a linear or branched polyhydroxyalkyl group with 3 to 10 carbon atoms and 3 to 10 hydroxyl groups. The polyhydroxyfatty acid amides are known substances, which may normally be obtained by reductive amination of a reducing sugar with ammonia, an alkylamine or an alkanolamine and subsequent acylation with a fatty acid, a fatty acid alkyl ester or a fatty acid chloride.

The group of the polyhydroxyfatty acid amides also includes compounds corresponding to the Formula

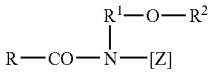

in which R is a linear or branched alkyl or alkenyl group containing 7 to 12 carbon atoms, $R^1$ is a linear, branched or cyclic alkyl group or an aryl group containing 2 to 8 carbon atoms and $R^2$ is a linear, branched or cyclic alkyl group or an aryl group or an oxyalkyl group containing 1 to 8 carbon atoms, $C_{1-4}$ alkyl or phenyl groups being preferred, and [Z] is a linear polyhydroxyalkyl group, of which the alkyl chain is substituted by at least two hydroxy groups, or alkoxylated, preferably ethoxylated or propoxylated derivatives of that group.

[Z] is preferably obtained by reductive amination of a reducing sugar, for example glucose, fructose, maltose, lactose, galactose, mannose or xylose. The N-alkoxy- or N-aryloxy-substituted compounds may then be converted into the required polyhydroxyfatty acid amides by reaction with fatty acid methyl esters in the presence of an alkoxide as catalyst.

Particularly preferred non-ionic surfactants in the context of the present invention have proved to be weakly foaming non-ionic surfactants, which have alternating ethylene oxide and alkylene oxide units. Among these, the surfactants with EO-AO-EO-AO blocks are again preferred, wherein one to ten EO or AO groups respectively are linked together, before a block of the other groups follows. Inventive rinsing agents are preferred here, which comprise surfactants of the general Formula (III) as the non-ionic surfactant(s)

$$R^1—O—(CH_2—CH_2—O)_w—(CH_2—CHR^2—O)_x—(CH_2—CH_2—O)_y—(CH_2—CHR^3—O)_z—H \quad \text{(III)},$$

in which $R^1$ stands for a linear or branched, saturated or mono- or polyunsaturated $C_{6-24}$ alkyl or alkenyl group, each group $R^2$ or $R^3$ independently of one another is selected from $—CH_3$, $—CH_2CH_3$, $—CH_2CH_2—CH_3$, $—CH(CH_3)_2$, and the indices w, x, y, z independently of each other stand for whole numbers from 1 to 6.

The preferred non-ionic surfactants of Formula (III) can be manufactured by known methods from the corresponding alcohols $R^1$—OH and ethylene- or alkylene oxide. The group $R^1$ in the previous Formula (III) can vary depending on the origin of the alcohol. When natural sources are used, the group $R^1$ has an even number of carbon atoms and generally is not branched, the linear alcohols of natural origin with 12 to 18 carbon atoms, for example coconut, palm, tallow or oleyl alcohol being preferred. The alcohols available from synthetic sources are, for example the Guerbet alcohols or mixtures of methyl branched in the 2-position or linear and methyl branched groups, as are typically present in oxo alcohols. Independently of the type of alcohol added for the manufacture of the non-ionic surfactants comprised in the compositions, inventive compositions are preferred, in which $R^1$ in Formula (III) stands for an alkyl group with 6 to 24, preferably 8 to 20, particularly preferably 9 to 15 and particularly 9 to 11 carbon atoms.

In addition to propylene oxide, especially butylene oxide can be the alkylene oxide unit that alternates with the ethylene oxide unit in the preferred non-ionic surfactants. However, also other alkylene oxides are suitable, in which $R^2$ or $R^3$ independently of one another are selected from $—CH_2CH_2—CH_3$ or $—CH(CH_3)_2$. Preferred compositions are those wherein $R^2$ or $R^3$ stand for a $—CH_3$ group, w and x independently of one another stand for values of 3 or 4 and y and z independently of one another stand for values of 1 or 2.

In summary, especially preferred inventive non-ionic surfactants for use in the compositions according to the invention are those that have a $C_{9-15}$ alkyl group with 1 to 4 ethylene oxide units, followed by 1 to 4 propylene oxide units, followed by 1 to 4 ethylene oxide units, followed by 1 to 4 propylene oxide units.

The preferred surfactants are weakly foaming non-ionic surfactants. The inventive compositions are especially preferred when they comprise a non-ionic surfactant that exhibits a melting point above room temperature. Accordingly, preferred compositions are characterized in that they comprise non-ionic surfactant(s) with a melting point above 20° C., preferably above 25° C., particularly preferably between 25 and 60° C. and, especially between 26.6 and 43.3° C.

Suitable non-ionic surfactants with a melting and/or softening point in the cited temperature range are, for example weakly foaming non-ionic surfactants that can be solid or highly viscous at room temperature. If non-ionic surfactants are used that are highly viscous at room temperature, they preferably have a viscosity above 20 Pas, particularly preferably above 35 Pas and especially above 40 Pas. Non-ionic surfactants that have a waxy consistency at room temperature are also preferred.

Preferred non-ionic surfactants that are solid at room temperature are used and belong to the groups of alkoxylated non-ionic surfactants, more particularly ethoxylated primary alcohols, and mixtures of these surfactants with structurally more complex surfactants, such as polyoxypropylene/polyoxyethylene/polyoxypropylene (PO/EO/PO) surfactants. Such (PO/EO/PO)-non-ionic surfactants are moreover characterized as having good foam control.

In one preferred embodiment of the present invention, the non-ionic surfactant with a melting point above room temperature is an ethoxylated non-ionic surfactant that results from the reaction of a monohydroxyalkanol or alkylphenol containing 6 to 20 carbon atoms with preferably at least 12 moles, particularly preferably at least 15 moles and especially at least 20 moles of ethylene oxide per mole of alcohol or alkylphenol.

A particularly preferred non-ionic surfactant that is solid at room temperature is obtained from a straight-chain fatty alcohol containing 16 to 20 carbon atoms ($C_{16-20}$ alcohol), preferably a C18 alcohol, and at least 12 moles, preferably at least 15 moles and more preferably at least 20 moles of ethylene oxide. Of these non-ionic surfactants, the so-called narrow range ethoxylates (see above) are particularly preferred.

Thus, particularly preferred compositions according to the invention comprise ethoxylated non-ionic surfactant(s) prepared from $C_{6-20}$ monohydric alkanols or $C_{6-20}$ alkyl phenols or $C_{16-20}$ fatty alcohols and more than 12 mole, preferably more than 15 mole and especially more than 20 mole ethylene oxide per mole alcohol.

Preferably, the non-ionic surfactant additionally possesses propylene oxide units in the molecule. These PO units preferably make up as much as 25% by weight, more preferably as much as 20% by weight and, especially up to 15% by weight of the total molecular weight of the non-ionic surfactant. Particularly preferred non-ionic surfactants are ethoxylated monohydroxyalkanols or alkylphenols, which have additional polyoxyethylene-polyoxypropylene block copolymer units. The alcohol or alkylphenol component of these non-ionic surfactant molecules preferably makes up more than 30 wt. %, more preferably more than 50 wt. % and most preferably more than 70 wt. % of the total molecular weight of these non-ionic surfactants. Preferred compositions are characterized in that they comprise ethoxylated and propoxylated non-ionic surfactants, in which the propylene oxide units in the molecule preferably make up as much as 25% by weight, more preferably as much as 20% by weight and, especially up to 15% by weight of the total molecular weight of the non-ionic surfactant.

Other particularly preferred non-ionic surfactants with melting points above room temperature comprise 40 to 70% of a polyoxypropylene/polyoxyethylene/polyoxypropylene block polymer blend that contains 75% by weight of an inverted block copolymer of polyoxyethylene and polyoxypropylene with 17 moles of ethylene oxide and 44 moles of propylene oxide and 25% by weight of a block copolymer of polyoxyethylene and polyoxypropylene initiated with trimethylolpropane and containing 24 moles of ethylene oxide and 99 moles of propylene oxide per mole of trimethylolpropane.

Non-ionic surfactants, which may be used with particular advantage, are obtainable, for example, under the name of Poly Tergent® SLF-18 from Olin Chemicals.

A further preferred inventive composition comprises non-ionic surfactants of the Formula $$R^1O[CH_2CH(CH_3)O]_x[CH_2CH_2O]_y[CH_2CH(OH)R^2],$$

in which $R^1$ stands for a linear or branched aliphatic hydrocarbon group with 4 to 18 carbon atoms or mixtures thereof, $R^2$ means a linear or branched hydrocarbon group with 2 to 26 carbon atoms or mixtures thereof and x stands for values between 0.5 and 1.5 and y stands for a value of at least 15.

Other preferred employable non-ionic surfactants are the end-capped poly(oxyalkylated) non-ionic surfactants corresponding to the Formula $$R^1O[CH_2CH(R^3)O]_x[CH_2]_kCH(OH)[CH_2]_jOR^2$$

in which $R^1$ and $R^2$ stand for linear or branched, saturated or unsaturated, aliphatic or aromatic hydrocarbon groups with 1 to 30 carbon atoms, $R^3$ stands for H or for a methyl, ethyl, n-propyl, isopropyl, n-butyl, 2-butyl or 2-methyl-2-butyl group, x stands for values between 1 and 30, k and j for values between 1 and 12, preferably between 1 and 5. Each $R^3$ in the above formula can be different for the case where $x \geqq 2$. $R^1$ and $R^2$ are preferably linear or branched, saturated or unsaturated, aliphatic or aromatic hydrocarbon groups containing 6 to 22 carbon atoms, groups containing 8 to 18 carbon atoms being particularly preferred. H, —$CH_3$ or —$CH_2CH_3$ are particularly preferred for the group $R^3$. Particularly preferred values for x are in the range from 1 to 20 and more particularly in the range from 6 to 15.

As described above, each $R^3$ in the above formula can be different for the case where $x \geqq 2$. By this means, the alkylene oxide unit in the straight brackets can be varied. If, for example, x has a value of 3, then the substituent $R^3$ may be selected to form ethylene oxide ($R^3$=H) or propylene oxide ($R^3$=$CH_3$) units which may be joined together in any order, for example (EO)(PO)(EO), (EO)(EO)(PO), (EO)(EO)(EO), (PO)(EO)(PO), (PO)(PO)(EO) and (PO)(PO)(PO). The value 3 for x was selected by way of example and may easily be larger, the range of variation increasing with increasing x-values and including, for example, a large number of (EO) groups combined with a small number of (PO) groups or vice versa.

Particularly preferred end-capped poly(oxyalkylated) alcohols corresponding to the above formula have values for both k and j of 1, so that the above formula can be simplified to $$R^1O[CH_2CH(R^3)O]_xCH_2CH(OH)CH_2OR^2$$

In this last formula, $R^1$, $R^2$ und $R^3$ are as defined above and x stands for a number from 1 to 30, preferably 1 to 20 and especially 6 to 18. Surfactants, in which the substituents $R^1$ and $R^2$ have 9 to 14 carbon atoms, $R^3$ stands for H and x takes a value of 6 to 15, are particularly preferred.

In summary, preferred inventive compositions comprise the end-capped poly(oxyalkylated) non-ionic surfactants of the Formula $$R^1O[CH_2CH(R^3)O]_x[CH_2]_kCH(OH)[CH_2]_jOR^2$$

in which $R^1$ and $R^2$ stand for linear or branched, saturated or unsaturated, aliphatic or aromatic hydrocarbon groups with 1 to 30 carbon atoms, $R^3$ stands for H or for a methyl, ethyl, n-propyl, isopropyl, n-butyl, 2-butyl or 2-methyl-2-butyl group, x has a value of 1 to 30, k and j have values of 1 to 12 and preferably 1 to 5, wherein surfactants of the type $$R^1O[CH_2CH(R^3)O]_xCH_2CH(OH)CH_2OR^2$$

in which x stands for numbers from 1 to 30, preferably 1 to 20 and especially 6 to 18, are particularly preferred.

Together with the cited surfactants, anionic, cationic and/or amphoteric surfactants can also be added, these playing only a minor role, due to their foam behavior in automatic dishwashing, and are mostly added in quantities below 10 wt. %, mostly even below 5 wt. %, for example from 0.01 to 2.5 wt. % respectively, based on the composition, in so far as the composition is an automatic dishwasher cleaning composition. Thus, the compositions according to the invention can also comprise anionic, cationic and/or amphoteric surfactants as the surfactant components.

In the context of the present invention, other preferred non-ionic surfactants are end-capped surfactants as well as non-ionic surfactants with butyloxy groups. The first group encompasses in particular representatives corresponding to the following Formula $$R^1O[CH_2CH(R^3)O]_xR^2,$$

in which $R^1$ is a linear or branched, saturated or unsaturated, aliphatic or aromatic hydrocarbon group with 1 to 30 carbon atoms, $R^2$ is a linear or branched, saturated or unsaturated, aliphatic or aromatic hydrocarbon group with 1 to 30 carbon atoms, which is optionally substituted with 1, 2, 3, 4 or 5 hydroxyl groups and optionally with further ether groups, $R^3$ stands for —H or for a methyl, ethyl, n-propyl, isopropyl, n-butyl, iso-butyl or tert.-butyl and x can assume a value between 1 and 40. $R^2$ can optionally be alkoxylated, wherein the alkoxy group is preferably selected from ethoxy, propoxy, butoxy groups and mixtures thereof.

Preferred surfactants corresponding to the above general formula are those in which $R^1$ is a $C_{9-11}$ or $C_{11-15}$ alkyl group, $R^3$=H and x assumes a value of 8 to 15, whereas $R^2$ is preferably a linear or branched saturated alkyl group. Particularly preferred surfactants can be described by the Formulas $C_{9-11}(EO)_{8-15}C(CH_3)_2CH_2CH_3$, $C_{11-15}(EO)_{15}(PO)_6$—$C_{12-14}$, $C_{9-11}(EO)_8(CH_2)_4CH_3$.

Mixed alkoxylated surfactants are also suitable, wherein those are preferred that possess butyloxy groups. These surfactants can be described by the Formula $$R^1(EO)_a(PO)_b(BO)_c$$

in which $R^1$ stands for a linear or branched, saturated or unsaturated, aliphatic or aromatic hydrocarbon group with 1 to 30, preferably 1 to 6 carbon atoms, a stands values between 2 and 30, b for values between 0 and 30 and c for values between 1 and 30, preferably between 1 and 20.

Alternatively, the EO and PO groups in the above formula may also be interchanged so that surfactants corresponding to the following general Formula $$R^1(PO)_b(EO)_a(BO)_c,$$

may also be used with advantage, in which $R^1$ stands for a linear or branched, saturated or unsaturated, aliphatic or aromatic hydrocarbon group with 1 to 30, preferably 1 to 6 carbon atoms, a stands for values between 2 and 30, b for values between 0 and 30 and c for values between 1 and 30, preferably between 1 and 20.

Particularly preferred representatives from this group of surfactants may be described by the formulas $C_{9-11}(PO)_3(EO)_{13}(BO)_{15}$, $C_{9-11}(PO)_3(EO)_{13}(BO)_6$, $C_{9-11}(PO)_3(EO)_{13}(BO)_3$, $C_{9-11}(EO)_{13}(BO)_6$, $C_{9-11}(EO)_{13}(BO)_3$, $C_{9-11}(PO)(EO)_{13}(BO)_3$, $C_{9-11}(EO)_8(BO)_3$, $C_{9-11}(EO)_8(BO)_2$, $C_{12-15}(EO)_7(BO)_2$, $C_{9-11}(EO)_8(BO)_2$, $C_{9-11}(EO)_8(BO)$. A particularly preferred surfactant of the Formula $C_{13-15}(EO)_{9-10}(BO)_{1-2}$ is commercially available under the name Plurafac® LF 221. An advantageously employable surfactant is also that with the Formula $C_{12-13}(EO)_{10}(BO)_2$.

In the context of the present invention, compositions, especially rinsing agents, are preferred that comprise the at least one non-ionic surfactant in quantities of 1 to 30 wt. %, preferably from 2.5 to 25 wt. %, particularly preferably from 3.5 to 20 wt. % and especially from 5 to 15 wt. %, each based on the composition.

The glass corrosion inhibiting multi-arm silyl polyalkoxylates can also be added into the inventive compositions in combination with additional glass corrosion protecting agents that are known from the prior art.

Accordingly, in another embodiment of the invention the inventive compositions additionally comprise, besides the glass corrosion inhibiting multi-arm silyl polyalkoxylate, at least one corrosion-protecting agent that is suitable for reducing the glass corrosion of a glass surface in automatic dishwashing.

This at least one optionally additionally present corrosion protection agent is particularly selected from the group of the magnesium and/or zinc salts of monomeric and/or polymeric organic acids, wherein the at least one acid is selected from the group of the non-branched, saturated or unsaturated monocarboxylic acids, the branched, saturated or unsaturated monocarboxylic acids, the saturated and unsaturated dicarboxylic acids, the non-branched or branched, unsaturated or saturated mono or polyhydroxylated fatty acids containing at least 8 carbon atoms, the aromatic mono-, di- and tricarboxylic acids, the sugar acids, the hydroxy acids, the oxoacids, the amino acids and/or the polymeric carboxylic acids.

Suitable additionally present agents that are capable of providing corrosion protection for glassware during cleaning and/or rinsing cycles, particularly in a dishwasher, are compounds that comprise zinc in an oxidized state, i.e. zinc compounds, in which cationic zinc is present. Analogously, magnesium salts are also preferred. In this connection, both soluble as well as sparingly soluble or insoluble zinc compounds or magnesium compounds can be comprised in the inventive compositions, wherein sparingly soluble or insoluble compounds must be suitably stabilized against precipitation (for example by the parameters of particle size of the particulate material and viscosity of the composition). In one embodiment, compositions according to the invention comprise at least one magnesium and/or zinc salt of at least one monomeric and/or polymeric organic acid.

In this case the acids in question are preferably derived from the group of the non-branched, saturated or unsaturated monocarboxylic acids, the branched, saturated or unsaturated monocarboxylic acids, the saturated and unsaturated dicarboxylic acids, the aromatic mono-, di- and tricarboxylic acids, the sugar acids, the hydroxy acids, the oxoacids, the amino acids and/or the polymeric carboxylic acids, the unsaturated or saturated, mono- or polyhydroxylated fatty acids containing at least 8 carbon atoms and/or resin acids.

Although according to the invention, any magnesium and/or zinc salt(s) of monomeric and/or polymeric organic acids can be comprised in the compositions according to the invention, the magnesium and/or zinc salts of monomeric and/or polymeric organic acids from the groups of the non-branched, saturated or unsaturated monocarboxylic acids, the branched, saturated or unsaturated monocarboxylic acids, the saturated and unsaturated dicarboxylic acids, the aromatic mono-, di- and tricarboxylic acids, the sugar acids, the hydroxy acids, the oxoacids, the amino acids and/or the polymeric carboxylic acids are, however, as described above, preferred. Within this group, in the context of the present invention, the following cited acids are again preferred:

From the group of the non-branched, saturated or unsaturated monocarboxylic acids: From the group of unbranched, saturated or unsaturated monocarboxylic acids: methanoic acid (formic acid), ethanoic acid (acetic acid), propanoic acid (propionic acid), pentanoic acid (valeric acid), hexanoic acid (caproic acid), heptanoic acid (enanthic acid), octanoic acid (caprylic acid), nonanoic acid (pelargonic acid), decanoic acid (caprinic acid), undecanoic acid, dodecanoic acid (lauric acid), tridecanoic acid, tetradecanoic acid (myristic acid), pentadecanoic acid, hexadecanoic acid (palmitic acid), heptadecanoic acid (margaric acid), octadecanoic acid (stearic acid), eicosanoic acid (arachic acid), docosanoic acid (behenic acid), tetracosanoic acid (lignoceric acid), hexacosanoic acid (cerotic acid), triacosanoic acid (melissic acid), 9c-hexadecenoic acid (palmitolenic acid), 6c-octadecenoic acid (petroselic acid), 6t-octadecenoic acid (petroselaidic acid), 9c-octadecenoic acid (oleic acid), 9t-octadecenoic acid (elaidic acid), 9c,12c-octadecadienoic acid (linoleic acid), 9t,12t-octadecadienoic acid (linolaidic acid) and 9c,12c,15c-octadecatrienoic acid (linolenic acid).

From the group of the branched, saturated or unsaturated monocarboxylic acids: 2-methylpentanoic acid, 2-ethylhexanoic acid, 2-propylheptanoic acid, 2-butyloctanoic acid, 2-pentylnonanoic acid, 2-hexyldecanoic acid, 2-heptylundecanoic acid, 2-octyldodecanoic acid, 2-nonyltridecanoic acid, 2-decyltetradecanoic acid, 2-undecylpentadecanoic acid, 2-dodecylhexadecanoic acid, 2-tridecylheptadecanoic acid, 2-tetradecyloctadecanoic acid, 2-pentadecylnonadecanoic acid, 2-hexadecyleicosanoic acid, and 2-heptadecylheneicosanoic acid.

From the group of the non-branched, saturated or unsaturated di- or tricarboxylic acids: propanedioic acid (malonic acid), butanedioic acid (succinic acid), pentanedioic acid (glutaric acid), hexanedioic acid (adipic acid), heptanedioic acid (pimelic acid), octanedioic acid (cork acid), nonanedioic acid (azelaic acid), decanedioic acid (sebacic acid), 2c-butenedioic acid (maleic acid), 2t-butenedioic acid (fumaric acid), but-2-ynedicarboxylic acid (acetylenedicarboxylic acid).

From the group of the aromatic mono-, di- and tricarboxylic acids: benzoic acid, 2-carboxybenzoic acid (phthalic acid), 3-carboxybenzoic acid (isophthalic acid), 4-carboxybenzoic acid (terephthalic acid), 3,4-dicarboxybenzoic acid (trimellitic acid), 3,5-dicarboxybenzoic acid (trimesic acid).

From the group of the sugar acids: galactonic acid, mannosaccharic acid, fructic acid, arabinic acid, xylic acid, ribonic acid, 2-desoxyribonic acid and alginic acid.

From the group of the hydroxyacids: hydroxyphenylacetic acid (mandelic acid), 2-hydroxypropionic acid (lactic acid), hydroxysuccinic acid (malic acid), 2,3-dihydroxybutanedioic acid (tartaric acid), 2-hydroxy-1,2,3-propanetricarboxylic acid (citric acid), ascorbic acid, 2-hydroxybenzoic acid (salicylic acid) and 3,4,5-trihydroxybenzoic acid (gallic acid).

From the group of the oxoacids: 2-oxopropionic acid (pyruvic acid) and 4-oxopentanoic acid (levulinic acid).

From the group of the amino acids: alanine, valine, leucine, isoleucine, proline, tryptophan, phenylalanine, methionine, glycine, serine, tyrosine, threonine, cysteine, asparagine, glutamine, asparaginic acid, glutamic acid, lysine, arginine and histidine.

From the group of the polymeric carboxylic acids: polyacrylic acid, polymethacrylic acid, alkylacrylamide/acrylic acid copolymers, alkylacrylamide/methacrylic acid copolymers, alkylacrylamide/methylmethacrylic acid copolymers, copolymers of unsaturated carboxylic acids, vinyl acetate/crotonic acid copolymers, vinyl pyrrolidone/vinyl acrylate copolymers.

The spectrum of the preferred zinc salts of organic acids, preferably organic carboxylic acids, ranges from salts that are sparingly soluble in water, i.e. with a solubility below 100 mg/L, preferably below 10 mg/L, to such salts with solubilities in water greater than 100 mg/L, preferably over 500 mg/L, particularly preferably over 1 g/L and especially over 5 g/L (all solubilities at a water temperature of 20° C.). The first group of zinc salts includes for example zinc citrate, zinc oleate and zinc stearate, the group of the soluble zinc salts includes for example, zinc formate, zinc acetate, zinc lactate, zinc tosylate (Zn salt of p-toluene sulfonic acid) and zinc gluconate.

In a further embodiment of the present invention, the inventive compositions comprise at least one zinc salt, however no magnesium salt of an organic acid, wherein at least one zinc salt of an organic carboxylic acid is preferred, particularly preferably a zinc salt from the group zinc stearate, zinc oleate, zinc gluconate, zinc acetate, zinc lactate and/or zinc citrate. Zinc ricinoleate, zinc abietate and zinc oxalate are also preferred.

Besides the glass corrosion inhibiting multi-arm silyl polyalkoxylate in the composition according to the invention, the optionally present at least one further corrosion protective agent is comprised in the composition particularly in quantities of 0.2 to 15 wt. %, preferably from 0.5 to 10 wt. %, particularly preferably from 1.0 to 7.5 wt. % and especially from 2 to 5 wt. %, each based on the composition.

Besides the at least one multi-arm silyl polyalkoxylate and the at least one non-ionic surfactant, the compositions according to the invention can comprise water and/or further active substances and/or auxiliaries to make up 100%. The most important ingredients which, besides the multi-arm silyl polyalkoxylates and non-ionic surfactants, can be comprised in the compositions according to the invention, are described below.

Acidifiers can be added to the compositions according to the invention, particularly in order to set a desired pH. Both inorganic acids such as for example hydrochloric acid or sulfuric acid, as well as organic acids such as for example acetic acid, lactic acid or citric acid are available as acidifiers, as long as they are compatible with the usual ingredients. For example, for the case that the composition according to the invention is a rinsing agent, it is generally desirable to lower the pH of the liquor in the rinse cycle and to adjust the rinsing agent to a pH of less than 7. For reasons of consumer protection and handling safety, the use of solid mono-, oligo- and polycarboxylic acids is particularly advantageous. Within this group, citric acid, tartaric acid, succinic acid, malonic acid, adipic acid, maleic acid, fumaric acid, oxalic acid and polyacrylic acid are again preferred. Organic sulfonic acids, such as amidosulfonic acid, may also be used. Sokalan® DCS (trademark of BASF), a mixture of succinic acid (max. 31% by weight), glutaric acid (max. 50% by weight) and adipic acid (max. 33% by weight), is commercially available and may also be used with advantage as an acidifying agent for the purposes of the present invention.

The acidifiers, especially mono-, oligo- and polycarboxylic acids, particularly preferably tartaric acid, succinic acid, malonic acid, adipic acid, maleic acid, fumaric acid, oxalic acid as well as polyacrylic acid and especially citric acid can be comprised in the compositions according to the invention in quantities for example of in total 0.5 to 15 wt. %, preferably from 1 to 7.5 wt. %, particularly preferably from 2 to 5 wt. % and especially from 2.5 to 4 wt. %, each based on the composition.

Naturally, the compositions according to the invention can also comprise salts of the abovementioned acids as buffer substances, i.e. the above-described acidifiers in the composition according to the invention can be partially neutralized. The alkali metal salts are preferred here, and among these the sodium salts are particularly preferred. The addition of trisodium citrate is particularly preferred according to the invention.

In a preferred embodiment of the invention, the compositions according to the invention exhibit an acidic to weakly alkaline pH, in particular a pH up to 9. The pH is preferably between 1 and 6, pH values from 2 to 4 being particularly preferred.

Non-aqueous solvents that can be employed in the composition according to the invention originate for example from the group of mono- or polyhydric alcohols, alkanolamines or glycol ethers. Preferably, the solvents are selected from ethanol, n- or i-propanol, butanols, glycol, propane- or butane diol, glycerine, diglycol, propyl- or butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl-, -ethyl- or -propyl ether, dipropylene glycol methyl-, or -ethyl ether, methoxy-, ethoxy- or butoxy triglycol, 1-butoxyethoxy-2-propanol, 3-methyl-3-methoxybutanol, propylene glycol t-butyl ether as well as mixtures of these solvents, such that preferred compositions are characterized in that they comprise at least one non-aqueous solvent, preferably ethanol, n-propanol, i-propanol, 1-butanol, 2-butanol, glycol, propane diol, butane diol, glycerine, diglycol, propyl diglycol, butyl diglycol, hexylene glycol, ethylene glycol methyl ether, ethylene glycol ethyl ether, ethylene glycol propyl ether, ethylene glycol mono-n-butyl ether, diethylene glycol methyl ether, diethylene glycol ethyl ether, propylene glycol methyl-, -ethyl- or -propyl ether, dipropylene glycol methyl-, or -ethyl ether, methoxy-, ethoxy- or butoxy triglycol, 1-butoxyethoxy-2-propanol, 3-methyl-3-methoxybutanol, propylene glycol t-butyl ether, or mixtures of these solvents. Ethanol is quite particularly preferred as the non-aqueous solvent.

The compositions of the present invention can also comprise hydrotropes, also called solubilizers. The addition of such materials causes a difficultly soluble substance to become water-soluble in the presence of the hydrotrope that is itself not a solvent. Substances that cause such an improved solubility are referred to as hydrotropes or hydrotropica. Typical hydrotropes, for example in the fabrication of liquid laundry detergents or cleaning compositions, are xylene sulfonate and cumene sulfonate. Other substances, for example urea or N-methylacetamide, increase the solubility by means of a structure-breaking effect, by which the water structure in the proximity of the hydrophobic group of a sparingly soluble material is broken down.

In the context of the present invention, preferred compositions comprise solubilizers, preferably aromatic sulfonates corresponding to the Formula

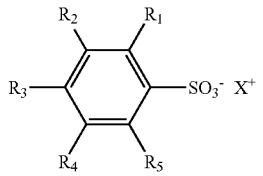

in quantities of 0.5 to 10 wt. %, preferably from 1 to 7.5 wt. %, particularly preferably from 2 to 5 wt. % and especially from 2.5 to 4 wt. %, each based on the composition, wherein each of the groups $R_1$, $R_2$, $R_3$, $R_4$, $R_5$ independently of each other is selected from H or a $C_{1-5}$ alkyl or alkenyl group and X stands for a cation.

Preferred substituents $R_1$, $R_2$, $R_3$, $R_4$, $R_5$ independently of one another are accordingly selected from H or a methyl, ethyl, n-propyl, iso-propyl, n-butyl, iso-butyl, tert.-butyl, n-pentyl, iso-pentyl or neo-pentyl group. Generally, at least three of the cited groups $R^1$ to $R^5$ are hydrogen atoms, aromatic sulfonates being preferred in which three or four substituents on the aromatic ring are hydrogen atoms. The remaining group or remaining two groups can take any position with respect to the sulfonate group and to each other. For monosubstituted compounds of Formula I, it is preferred if the group $R_3$ is an alkyl group, while $R_1$, $R_2$, $R_4$, and $R_5$ stand for H (para substitution).

In the context of the present invention, particularly preferred aromatic sulfonates are toluene-, cumene- or xylene sulfonate.

Of the two industrially available toluene sulfonates (ortho and para toluene sulfonate), the para isomer is preferred in the context of the present invention. For the cumene sulfonates, the para isopropylbenzene sulfonate is also the preferred compound. As industrial xylene is mostly used as its mixture of isomers, the industrially available xylene sulfonate is also a mixture of several compounds that result from the sulfonation of ortho, meta and para xylene. In these mixtures of isomers, compounds predominate in which each of the following groups stand for methyl groups in the general Formula I (all other groups stand for H): $R_1$ and $R_2$, $R_1$ and $R_4$, $R_1$ and $R_3$ as well as $R_1$ and $R_5$. Accordingly, xylene sulfonates are preferred with at least one methyl group ortho to the sulfonate group.

In the above-cited general Formula, X stands for a cation, for example an alkali metal cation such as sodium or potassium. X can also stand for the equivalently charged ratios of a multivalent cation, for example $Mg^{2+}/2$ or $Al^{3+}/3$, the sodium cation being preferred among the cited cations.

Further preferred embodiments of the present invention are compositions for the automatic cleaning of a glass surface, in particular rinsing agents for automatic dishwashing, comprising a) 0.05 to 10, preferably 0.1 to 7, particularly preferably 0.2 to 5 and especially 0.3 to 3 wt. % of at least one multi-arm silyl polyalkoxylate of Formula (I)
b) 0.1 to 40, preferably 1 to 20, particularly preferably 5 to 20 wt. % of at least one non-ionic surfactant, in particular a mixture of at least one polyalkoxylate and at least one end-capped poly(oxyalkoxylated) non-ionic surfactant
c) 0 to 15, preferably 1 to 10, particularly preferably 2 to 7 wt. % of at least one acidifier
d) 1 to 20, preferably 2 to 15, particularly preferably 3 to 10 wt. % of at least one non-aqueous solvent and/or solubilizer
e) water.

If the composition is a concentrate that is to be diluted before use, then the content of non-ionic surfactants is in the upper range of the cited limits, whereas for a ready to use composition the content is in the lower range of the cited limits and preferably is up to about 15 wt. %.

In another embodiment of the invention, the compositions according to the invention can additionally comprise one or more substances from the group of the soil-release polymers, the colorants and the fragrances.

Substances that prevent resoiling of surfaces and/or facilitate stain removal after a single use are so-called "soil-release compounds". Inventively employable soil-release compounds include any of the compounds known in the prior art for this purpose. Cationic polymers, in particular polymers that contain imino groups, cationic cellulose derivatives or cationic homopolymers and/or copolymers containing quaternized ammonium alkyl methacrylate groups as the monomer units are particularly suitable.

Particularly preferred soil release compounds are cationic polymers selected from cationic polymers of copolymers of such monomers as trialkyl ammonium alkyl (meth)acrylate or -acrylamide; dialkyl diallyl diammonium salts; polymer-analog reaction products of ethers or esters of polysaccharides containing pendant ammonium groups, in particular guar, cellulose and starch derivatives; polyadducts of ethylene oxide with ammonium groups; quaternary ethylene imine polymers and polyesters and polyamides containing pendant quaternary groups.

Natural polyuronic acids and related substances, as well as polyampholytes and hydrophobicized polyampholytes and mixtures of these substances are also particularly preferred in the context of the invention.

In order to enhance the esthetic impression of the compositions of the invention, they may be colored with appropriate colorants. In the context of the present invention, preferred colorants, which are not difficult for the expert to choose, have high storage stability, are not affected by the other ingredients of the composition or by light and in particular do not have any pronounced substantivity for the tableware, so as not to color them.

For use in the inventive compositions, all dyes are preferred that can be oxidatively destroyed, as well as mixtures thereof with suitable blue colorants, the "blue toners". It has also proved advantageous to employ dyes that are soluble in water or in liquid organic substances at room temperature. Anionic dyes, for example anionic nitroso dyes, are suitable. A possible dye is Naphtholgrün, for example, (Color Index (CI)

Part 1: Acid Green 1, Part 2: 10020), which is commercially available as Basacid® Grün 970 from BASF, Ludwigshafen, together with its mixtures with suitable blue colorants. Additional dyes that can be employed are Pigmosol® Blau 6900 (CI 74160), Pigmosol® Grün 8730 (CI 74260), Basonyl® Rot 545 FL (CI 45170), Sandolan® Rhodamin EB400 (CI 45100), Basacid® Gelb 094 (CI 47005), Sicovit® Patentblau 85 E 131 (CI 42051), Acid Blue 183 (CAS 12217-22-0, CI Acid blue 183), Pigment Blue 15 (CI 74160), Supranol® Blau GLW (CAS 12219-32-8, CI Acidblue 221)), Nylosan® Gelb N-7GL SGR (CAS 61814-57-1, CI Acidyellow 218) and/or Sandolan® Blau (CI Acid Blue 182, CAS 12219-26-0).

Care must be taken when selecting the dye that the dye does not have too strong an affinity towards the surfaces to be treated and particularly here towards plastics that are also possibly present. At the same time, the different stabilities of colorants towards oxidation must also be borne in mind when choosing suitable colorants. In general, water-insoluble dyes are more stable to oxidation than are water-soluble dyes. The concentration of the dye in the compositions according to the invention is varied depending on the solubility and hence also on the propensity to oxidation. For highly soluble dyes, e.g. the above cited Basacid® Green or the Sandolan® Blue, also cited above, dye concentrations are typically chosen in the range of several $10^{-2}$ to $10^{-3}$ wt. %. For the less highly soluble, but due to their brilliance, particularly preferred pigment dyes, e.g. the above cited Pigmosol® dyes, their suitable concentration in detergents or cleaning compositions, in contrast, is typically several $10^{-3}$ to $10^{-4}$ wt. %.

The inventive compositions can further comprise at least one fragrance, especially a perfume. For the case that the composition according to the invention is an automatic dishwasher rinsing agent or a rinsing agent, the "wash odor" that frequently occurs with automatic dishwashers when the machine is opened, can be eliminated by a late release of the perfume in the rinse cycle. In addition, fragrances may be added to the compositions of the present invention in order to improve the esthetic impression created by the products and to provide the consumer not only with the required performance but also with a visually and sensorially "typical and unmistakable product".

In the context of the present invention, basically any substance or mixture of substances which are typically used for perfuming cleaning compositions and which are compatible with the other ingredients of the composition according to the invention can be employed as the perfume oils or fragrances.

Another subject matter of the present invention is the use of a composition, as has been previously described, for reducing glass corrosion and/or for improving the drying behavior during the automatic cleaning of a glass surface, in particular during automatic dishwashing.

While particular embodiments of the present invention have been illustrated and described, it would be obvious to those skilled in the art that various other changes and modifications can be made without departing from the spirit and scope of the invention.

Other than where otherwise indicated, or where required to distinguish over the prior art, all numbers expressing quantities of ingredients herein are to be understood as modified in all instances by the term "about". As used herein, the words "may" and "may be" are to be interpreted in an open-ended, non-restrictive manner. At minimum, "may" and "may be" are to be interpreted as definitively including, but not limited to, the composition, structure, or act recited.

As used herein, and in particular as used herein to define the elements of the claims that follow, the articles "a" and "an" are synonymous and used interchangeably with "at least one" or "one or more," disclosing or encompassing both the singular and the plural, unless specifically defined herein otherwise. The conjunction "or" is used herein in both in the conjunctive and disjunctive sense, such that phrases or terms conjoined by "or" disclose or encompass each phrase or term alone as well as any combination so conjoined, unless specifically defined herein otherwise.

The description of a group or class of materials as suitable or preferred for a given purpose in connection with the invention implies that mixtures of any two or more of the members of the group or class are equally suitable or preferred. Description of constituents in chemical terms refers unless otherwise indicated, to the constituents at the time of addition to any combination specified in the description, and does not necessarily preclude chemical interactions among the constituents of a mixture once mixed. Steps in any method disclosed or claimed need not be performed in the order recited, except as otherwise specifically disclosed or claimed.

Changes in form and substitution of equivalents are contemplated as circumstances may suggest or render expedient. Although specific terms have been employed herein, such terms are intended in a descriptive sense and not for purposes of limitation.

The following Examples further illustrate the preferred embodiments within the scope of the present invention, but are not intended to be limiting thereof. It is understood that the examples and embodiments described herein are for illustrative purposes only and that various modifications or changes in light thereof will be suggested to one skilled in the art without departing from the scope of the present invention. The appended claims therefore are intended to cover all such changes and modifications that are within the scope of this invention.

EXAMPLES

1. Production of a Six-Arm Triethoxysilyl-Terminated Polyalkoxylate

A polyether polyol was used as the starting material which represents a 6-arm statistical poly(ethylene oxide-co-propylene oxide) with an EO/PO ratio of 80/20 and a molecular weight of 12 000 g/mol. It was manufactured by anionic ring-opening polymerization of ethylene oxide and propylene oxide using sorbitol as the initiator. Prior to the further reaction, the polyether polyol was heated to 80° C. with stirring under a vacuum for 1 h. To a solution of polyether polyol (3 g, 0.25 mmol), triethylenediamine (9 mg, 0.081 mmol) and dibutyltin dilaurate (9 mg, 0.014 mmol) in 25 ml anhydrous toluene was added drop wise a solution of (3-isocyanatopropyl)triethoxysilane (0.6 ml, 2.30 mmol) in 10 ml anhydrous toluene. The solution was stirred overnight at 50° C. After the toluene had been removed under vacuum, the crude product was repeatedly washed with anhydrous ether. After drying under vacuum, the product was obtained as a colorless viscous liquid; it possessed a triethoxysilyl group on each free end of the polymer arms of the star-shaped prepolymer. IR (Film, $cm^{-1}$): 3349 (m, —CO—NH—), 2868 (s, —$CH_2$—, —$CH_3$), 1719 (s, —C═O), 1456 (m, —$CH_2$—, —$CH_3$), 1107 (s, —C—O—C—), 954 (m, —Si—O—). $^1$H-NMR (benzene-$d_6$, ppm): 1.13 (d, —$CH_3$ of the polymer arms), 1.21 (t, —$CH_3$ of the silane end groups), 3.47 (s, —$CH_2$ of the polymer arms), 3.74 (q, —$CH_2$ of the silane end groups). The molecular weight of the triethoxysilyl terminated polyalkoxylate was 13 500.

2. Production of a Three-Arm Triethoxysilyl-Terminated Polyalkoxylate

Voranol CP 1421 from DOW Chemicals was dried under vacuum with stirring for 1 h at 80° C. To 2.04 g (0.41 mmol) of the dried polyether polyol were slowly added 317 mg (1.0 equivalent) 3-isocyanatopropyl)triethoxysilane. The reaction mixture was stirred at 100° C. for 2 days under inert gas until the disappearance of the characteristic IR peak of the NCO group. After drying under vacuum, the product was obtained as a colorless viscous liquid; it possessed a triethoxysilyl group on each free end of the polymer arms of the polyether polyol.

3. Production of a Mixture Comprising a Three-Arm as Well as an Eight Arm Triethoxysilyl-Terminated Polyalkoxylate Voranol CP 4053 from DOW Chemicals was dried under vacuum with stirring for 1 h at 80° C. To 209 g (16.9 mmol) of the dried polyether polyol were slowly added 20.9 mg (0.01%) dibutyltin dilaurate and 30.3 g (1.0 equivalent) 3-isocyanatopropyltriethoxysilane. The reaction mixture was stirred at room temperature for 2 days under inert gas until the disappearance of the characteristic IR peak of the NCO group. The product was obtained as a colorless viscous liquid; it possessed a triethoxysilyl group on each free end of the polymer arms of the polyether polyol and was a mixture of a 3-arm and an 8-arm polyalkoxylate in a ratio of ca. 20/80.

4. Glass Corrosion Test According to the Prior Art (Comparative Test A)

In a continuously running domestic dishwasher of the type Miele G 6xx were washed various commercially available drinking glasses and plates at a water hardness of 0-1° dH with a commercially available automatic dishwasher detergent in the form of a tablet. After 50 cleaning cycles the glass corrosion on the cleaned objects was assessed in regard to the parameters cloudiness and corrosion lines. The results are presented in the following Table.

| Glass | Type | Cloudiness | Corrosion lines |
|---|---|---|---|
| Highlight (Bohemia Crystal) | Potash crystal | 2.5 | 0 |
| Tina (Steklarna Hrastnik) | Soda-lime | 2.5 | 3 |
| Ballon (ARC) | Soda-lime | 2 | 3 |
| Chardonnay (Stöltzle Oberglas) | Potash crystal | 2 | 1 |
| Riserva (Bormioli Rocco) | Potash crystal | 1 | 2.5 |
| Michelangelo (Luigi Bormioli) | Potash crystal | 2 | 3 |
| Panal Tumbler (Libbey) | Soda-lime | 2 | 0 |
| Vina (Libbey) | Soda-lime | 3 | 3 |

Evaluation scale: 0 to 5, wherein 0 stands for undamaged glasses and 5 for very heavy corrosion damage.

The results for the pattern fading after 50 wash cycles are shown in the following Table:

| Type | Fading |
|---|---|
| Drinking glass green (Montana) | 2 |
| Drinking glass bkue (Montana) | 1.5 |
| Plate Piano (Bormioli Rocco) | 1 |

Evaluation scale: 0 to 5, wherein 0 stands for an imperceptible fading and 5 for a very pronounced fading.

Differences of 1 point are considered to be significant.

8. Glass Corrosion Test According to the Prior Art (Comparative Test B)

The test was carried out as described under 4. (Glass corrosion test according to the prior art, comparative test A), but 3 ml of a commercially available rinsing agent were automatically directly metered into the machine at the start of the rinse cycle. This rinsing agent comprised 2.5 wt. % zinc acetate as the glass corrosion protection component. After 50 cleaning cycles the glass corrosion on the cleaned objects was assessed in regard to the parameters cloudiness and corrosion lines. The results are presented in the following Table.

| Glass | Type | Cloudiness | Corrosion lines |
|---|---|---|---|
| Highlight (Bohemia Crystal) | Potash crystal | 1.5 | 0 |
| Tina (Steklarna Hrastnik) | Soda-lime | 0.5 | 0 |
| Ballon (ARC) | Soda-lime | 0.5 | 0 |
| Chardonnay (Stöltzle Oberglas) | Potash crystal | 0 | 0 |
| Riserva (Bormioli Rocco) | Potash crystal | 1.5 | 0 |
| Panal Tumbler (Libbey) | Soda-lime | 1.5 | 0 |
| Vina (Libbey) | Soda-lime | 0.5 | 0 |

The results for the pattern fading after 50 wash cycles are shown in the following Table:

| Type | Fading |
|---|---|
| Drinking glass green (Montana) | 1 |
| Drinking glass bkue (Montana) | 0.5 |
| Plate Piano (Bormioli Rocco) | 0.5 |

8. Glass Corrosion Test According to the Present Invention

A formulation F was first produced with the following composition: 1.0 wt. % of the triethoxysilyl-terminated polyalkoxylate from example 120.0 wt. % ethanol 79.0 wt. % water.

In a continuously running domestic dishwasher of the type Miele G 6xx were washed various commercially available drinking glasses and plates at a water hardness of 0-1° dH with a commercially available automatic dishwasher detergent in the form of a tablet. 1 ml of the formulation F was automatically directly metered into the machine at the beginning of the rinse cycle. The results for the glass corrosion (cloudiness and corrosion lines) after 50 wash cycles are presented in the following Table:

| Glass | Type | Cloudiness | Corrosion lines |
|---|---|---|---|
| Highlight (Bohemia Crystal) | Potash crystal | 1 | 0 |
| Tina (Steklarna Hrastnik) | Soda-lime | 0.5 | 0 |
| Ballon (ARC) | Soda-lime | 0.5 | 0 |
| Chardonnay (Stöltzle Oberglas) | Potash crystal | 0 | 0 |
| Riserva (Bormioli Rocco) | Potash crystal | 0 | 0 |
| Michelangelo (Luigi Bormioli) | Potash crystal | 0 | 0 |
| Panal Tumbler (Libbey) | Soda-lime | 0.5 | 0 |
| Vina (Libbey) | Soda-lime | 0 | 0 |

The results for the pattern fading after 50 wash cycles are shown in the following Table:

| Type | Fading |
|---|---|
| Drinking glass green (Montana) | 1 |
| Drinking glass blue (Montana) | 1 |
| Plate Piano (Bormioli Rocco) | 0.5 |

8. Evaluation of Tests 4 to 6

The comparison of the wash tests from examples 4 and 6 shows that the use of 10 mg of the silyl polyalkoxylate affords a significantly reduced glass corrosion. This can be seen both in the cloudiness as well as in the corrosion lines. Moreover, the resistance of decorated glass is improved, as shown by a reduced fading of the pattern. The comparison of the washing tests from the examples 5 and 6 shows that with the silyl polyalkoxylate according to the invention, even at a 7.5 times lower added concentration, comparatively good or even better effects were obtained as with zinc acetate that represents a conventional glass protection agent from the prior art.

Similarly good results were obtained when one of the triethoxysilyl-terminated polyalkoxylates from the examples 2 and 3 was added instead of the triethoxysilyl-terminated polyalkoxylate from example 1.

8. Test Results for Additional Effects

It has also been found that the use of multi-arm silyl polyalkoxylates in the automatic cleaning of glass surfaces improves the drying behavior of the cleaned surfaces. This is understood in particular to mean a shorter drying time and/or a reduced formation of lime scale spots and deposits on the cleaned surfaces. This was shown in washing tests in a domestic dishwasher of the type Miele G 1730 (automatic program, temperature during the cleaning cycle 45-65° C.). Wine glasses and black plates were used as the washed goods, which had been pre-cleaned in a commercially available automatic dishwashing detergent. The silyl polyalkoxylate, each in the form of 5 ml of a formulation G, was metered into the interior of the automatic dishwasher in the cleaning cycle. At the end of the program, the time for the surfaces to dry was measured, and the degree of lime scale spots or deposits was visually determined and each was evaluated in comparison with the reference values. Washed goods that had been cleaned in the same way served as the reference value, wherein, however, the formulation G comprised an equal weight of water instead of the silyl compound(s).

The following scale was used for the evaluation:

| | |
|---|---|
| +++ | very significantly better[1] than the reference, |
| ++ | significantly better than the reference, |
| + | somewhat better than the reference, |
| – | no different from the reference, |

[1]"better" means in the case of a) drying time: faster drying b) spot formation: less water residues, lower degree of spots 8.1

The six-arm triethoxysilyl terminated polyalkoxylate from synthesis example 1 was used as the silyl polyalkoxylate.

Formulation G consisted of:

| | |
|---|---|
| x g | silyl polyalkoxylate (x value, see Table) |
| y g | tetraethoxysilane (y value, see Table) |
| 2.5 g | water |
| 2.5 g | acetic acid |
| ad 100 g | ethanol. |

Results:

| x | y | Drying time | Streak formation |
|---|---|---|---|
| 5.0 | 0 | – | – |
| 15 | 0 | + | + |
| 5.0 | 10 | +++ | +++ |

The same results were obtained when one of the silyl polyalkoxylates from the synthesis example 3 was used instead of the silyl polyalkoxylate from synthesis example 1. Likewise, the same results were each obtained with both silyl polyalkoxylates, when the formulation G was not metered into the interior of the dishwasher in the cleaning cycle but rather in the rinsing cycle.

8.2

The mixture comprising a three-arm as well as an eight-arm triethoxysilyl terminated polyalkoxylate from synthesis example 3 was employed as the silyl polyalkoxylate.

Formulation G consisted of:

| | |
|---|---|
| x g | silyl polyalkoxylate (x value, see Table) |
| ad 100 g | water. |

Results:

| x | Drying time | Streak formation |
|---|---|---|
| 2.5 | – | – |
| 5.0 | ++ | ++ |
| 10 | +++ | +++ |

The same results were obtained when the formulation G was metered into the interior of the automatic dishwasher, not in the cleaning cycle but rather in the rinsing cycle.

Similar results were obtained in the test configurations 8.1 and 8.2 when the silyl polyalkoxylate from synthesis example 2 was used as the silyl polyalkoxylate.

What is claimed is:

1. A composition for cleaning a glass surface, comprising:

a) 0.05 to 10 wt. % of at least one multi-arm silyl polyalkoxylate of formula (I)

$$(H\text{-}A)_n\text{-}Z\text{-}[A\text{-}B\text{-}Si(OR^1)_r(R^2)_{3-r}]_m \quad (I)$$

in which

Z stands for an (m+n) valent group having at least three carbon atoms,

A stands for a (co)polymer of ethylene oxide and propylene oxide having a propylene oxide content of up to 30% by weight, wherein the (m+n) (co)polymer groups A that are bonded to Z can be different from one another, and wherein one A group is bonded to Z through an oxygen atom that belongs to Z, and one oxygen atom that belongs to A is bonded to B or hydrogen, B stands for a chemical bond or for a divalent organic group having 1 to 50 carbon atoms, $OR^1$ means a hydrolysable group, $R^1$ and $R^2$ independently of one another mean a linear or branched alkyl group containing 1 to 6 carbon atoms and r stands for a whole number from 1 to 3, and m is a whole number $\geqq 1$ and n stands for 0 or a whole number $\geqq 1$, and m+n has a value from 3 to 100;

b) 0.1 to 40 wt. % of at least one non-ionic surfactant; and c) optionally water and/or one or more corrosion-protection agents, acidifiers, non-aqueous solvents and solubilizers.

2. The composition of claim 1, comprising 1% to 30% by weight of the at least one non-ionic surfactant, based on the composition.

3. The composition of claim 2, comprising 2.5% to 25% by weight of the at least one non-ionic surfactant, based on the composition.

4. The composition of claim 3, comprising 3.5% to 20% by weight of the at least one non-ionic surfactant, based on the composition.

5. The composition of claim 1, comprising 5% to 15% by weight of the at least one non-ionic surfactant, based on the composition.

* * * * *